United States Patent [19]

Weaver

[11] Patent Number: 4,779,076

[45] Date of Patent: Oct. 18, 1988

[54] DEACTIVATABLE CODED MARKER AND MAGNETIC ARTICLE SURVEILLANCE SYSTEM

[75] Inventor: Jon N. Weaver, Lake Park, Fla.

[73] Assignee: Controlled Information Corp., Lake Park, Fla.

[21] Appl. No.: 52,240

[22] Filed: May 20, 1987

[51] Int. Cl.[4] ..... G08B 13/18

[52] U.S. Cl. ..... 340/551; 340/572

[58] Field of Search ..... 340/551, 572; 342/27

[56] References Cited

U.S. PATENT DOCUMENTS

| | | | |
|---|---|---|---|
| 3,292,080 | 12/1966 | Trikilis | 324/200 |
| 3,665,449 | 5/1972 | Elder et al. | 340/572 |
| 3,747,086 | 7/1973 | Peterson | 340/572 |
| 3,765,007 | 10/1973 | Elder | 340/572 |
| 3,790,945 | 2/1974 | Fearon | 340/572 |
| 3,803,571 | 4/1974 | Luz | 340/573 |
| 3,820,090 | 6/1974 | Wiegand | 340/551 |
| 3,820,103 | 6/1974 | Fearon | 340/572 |
| 3,820,104 | 6/1974 | Fearon | 340/572 |
| 3,891,980 | 6/1975 | Lewis et al. | 340/572 |
| 3,938,125 | 2/1976 | Benassi | 340/572 |
| 3,983,552 | 9/1976 | Bakeman, Jr. et al. | 340/572 |
| 4,063,230 | 12/1977 | Purinton et al. | 340/572 |
| 4,134,538 | 1/1979 | Lagavde et al. | 235/449 |
| 4,298,862 | 11/1981 | Gregor et al. | 340/572 |
| 4,309,697 | 1/1982 | Weaver | 340/572 |
| 4,384,281 | 5/1983 | Cooper | 340/572 |
| 4,413,254 | 11/1983 | Pinneo et al. | 340/572 |
| 4,489,313 | 12/1984 | Pfister | 340/572 |
| 4,622,542 | 11/1986 | Weaver | 340/572 |
| 4,675,657 | 6/1987 | Weaver | 340/551 |

FOREIGN PATENT DOCUMENTS

| | | | |
|---|---|---|---|
| 763681 | 8/1934 | France | 340/551 |

*Primary Examiner*—Glen R. Swann, III

*Attorney, Agent, or Firm*—Steele Gould & Fried

[57] ABSTRACT

A deactivatable coded marker for use in article surveillance systems has a core of soft magnetic material. An electrically conductive element at least partly surrounds the core, by reason of which the marker will generate a phase-shifted harmonic signal responsive to a reference signal. A magnetizable element of high coercivity is adjacent to and overlying the electrically conductive material, the marker generating the phase-shifted harmonic signal when the high coercivity element is not magnetized but generating a non-phase-shifted harmonic signal responsive to the reference signal when the high coercivity element is magnetized, whereby the high coercivity element neutralizes the effect of the electrically conductive element when magnetized. The deactivatable marker may have a plurality of cores, a plurality of electrically conductive elements and a plurality of separately magnetizable elements, forming respective and independently activatable and deactivatable marker parts. An article surveillance system for use with such deactivatable markers has an automatic gain control for continuously adjusting the intensity of transmitted reference signals responsive to the intensity of the received harmonic signals to compensate for the variation due to marker presence in a detection zone, thereby preventing random variation in the phase shift of the harmonic signals.

20 Claims, 1 Drawing Sheet

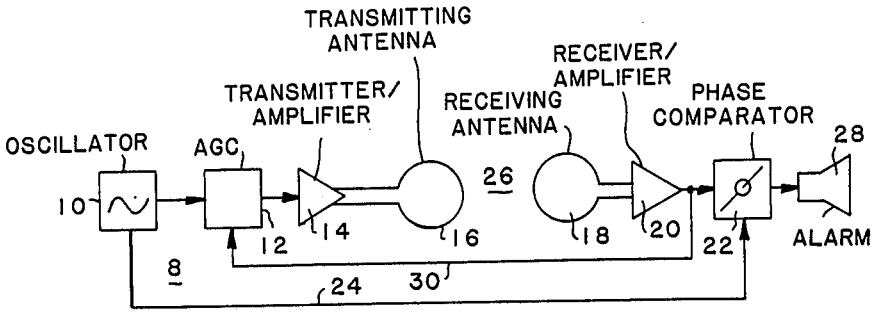
FIG. 1
FIG. 3
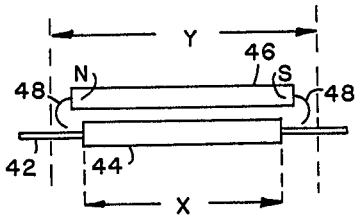
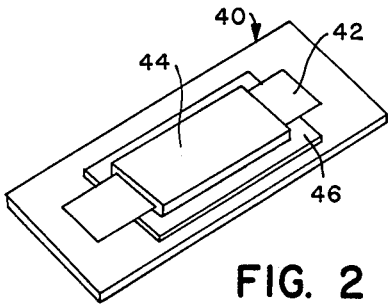
FIG. 2
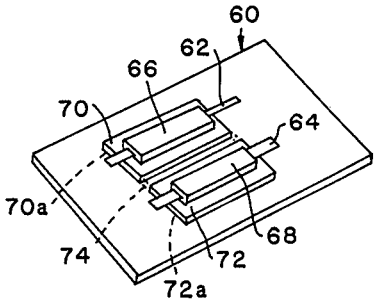
FIG. 4
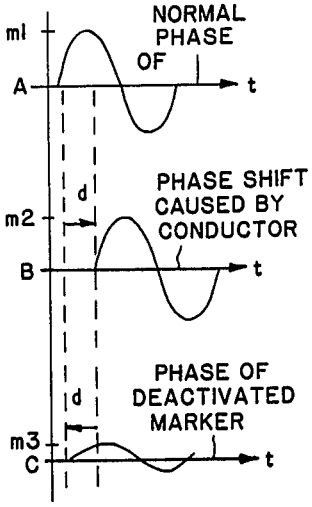
FIG. 5

DEACTIVATABLE CODED MARKER AND MAGNETIC ARTICLE SURVEILLANCE SYSTEM

BACKGROUND OF THE INVENTION

1. Field of the Invention

The invention relates to magnetic article surveillance systems in general, and in particular, to deactivatable coded markers for such systems.

2. Statement of Art

Article surveillance systems using soft magnetic materials and low frequency detection systems have been known since the Picard patent No. (763,861) was issued in France in 1934. Picard discovered that when a piece of metal is subjected to a sinusoidally varying magnetic field, an induced voltage, characteristic of the metal composition, is produced in a pair of balanced coils in the vicinity of the applied field. Today, such systems utilize the harmonics produced by a marker of soft magnetic strip to detect the marker. Due to the nonlinear characteristics of such markers, groups of even and odd order harmonics can be produced simultaneously or individually. Odd order (1, 3, 5 . . . ) harmonics are produced by a symmetrical switching of the B/H loop. Even order harmonics (2, 4, 6 . . . ) are produced by a non-symmetrical switching condition, typically caused by a D.C. magnetic bias internal or external to the material.

The nonlinear characteristics of the soft magnetic material, while not commonly found, can be duplicated is some ferrous alloys by the presence of a magnetic bias. This results in the generation of even and odd order harmonics that duplicates the response of soft magnetic materials, such as Permalloy and the metallic glass products. However, the use of more sensitive detection equipment can add to the probability of false alarms due to ferrous alloys. More sensitive detection equipment also increases the difficulty of effectively deactivating markers, that is, turning markers, "off".

Another limitation of the soft strip low frequency system is that only a single bit of information is available during marker and system interaction. The marker is either in the detection zone, or not. The only other alternative is that the marker is, whether or not in the detection zone, deactivated. While this is not a disadvantage for systems used in theft control, it is an extreme limitation when used for monitoring the flow of a group of differing objects, or even persons, through the detection zone.

Those systems using coded devices for monitoring people and articles in a selected area are quite capable of a large number of codes. Card access systems are a good example. They generally combine a digital network and/or radio frequency circuit to transmit the code. However these devices are too expensive to use either for theft control of low cost items or for inventory control in factories or stores. It is understood that encoded markers can be affixed to or otherwise carried by any article or person, animal, etc. The term "article" is used herein to encompass such possibilities.

A magnetic article surveillance system disclosed in U.S. Pat. No. 4,622,542 differed from the prior art in that the codes utilized are not duplicated by biased ferrous alloys, even accidentally. Further, the coded marker can be embodied in a single element device and can be programmed (code changed) by altering the geometry of or extent of a conductor surrounding a magnetic core. It is detectable at large distances and is not sensitive to spatial orientation within the system. Article surveillance is based upon the detection of phase shifted harmonics generated by markers in a detection zone. The number of codes does not depend on the marker structure but on the phase resolution of the detection system and programming device. Such a system, based upon phase shifted harmonics, has lent itself to an improved system for reliably deactivating magnetic markers, which system is taught herein.

The concept of this invention can best be appreciated in contrast to the teachings of specific and representative patents. The prior art can be broken down into the following classifications of coded markers, which nevertheless share a common deactivation technology: (1) single element; (2) multiple element (3) biased (magnetized); and, (4) unbiased.

A bistable magnetic device is disclosed in U.S. Pat. No. 3,820,090-Wiegand. The marker is in the form of a wire, preferably with a magnetically "hard" magnetized outer shell (having a relatively high coercivity) and a moderately "soft" magnetic core (having a relatively low coercivity). Coercivity is a measure of the external magnetic field strength needed to neutralize the net magnetization of a magnetized ferromagnetic material. The magnetized shell portion is operable for magnetizing the core portion in a first direction, the magnetization of the core portion is reversible by application of a separate magnetic field and the shell is operable to remagnetize the core portion in the first direction upon removal of the separate magnetic field. The device requires a fixed orientation to the interrogation field. The system can produce additional codes only by using multiple elements. Such devices are generally used for close proximity card access systems.

The device disclosed in U.S. Pat. No. 3,747,086-Peterson uses multiple elements to bias a soft magnetic strip. The marker comprises a plurality of ferromagnetic elements including a first element capable of generating a signal containing harmonics of an exciting oscillatory interrogating field and a second element having a coercive force greater than the first element and capable of retaining a state of magnetization when exposed to the interrogation field, such that when so magnetized, a magnetic bias is imposed on the first element to prevent the generation of the harmonic signal. Four possibilities (codes) exist depending on which element is magnetized. However, these codes are easily reproduced in any biased, ferrous alloy. The system is neither unique nor reliable.

The system disclosed in U.S. Pat. No. 3,765,007-Elder uses markers of "n" number of elements with differing AC coercivities to produce "n" number of codes. When the elements are subjected to a periodically varying magnetic field, the magnetization of the elements reverses sequentially at equal intervals of time. Like Peterson, Elder's system is prone to false alarms from biased, ferrous alloys which inadvertently, and all to frequently, duplicate the code. Moreover, a plurality of magnetic field producing means must be used to cover all orientations of the coded elements (markers).

The system disclosed in U.S. Pat. No. 4,134,538-Lagard, et al. uses markers of "n" multiple elements or bands producing varying amplitudes as a code. Such magnetic bands are selectively divided at variable predetermined locations by cuts of variable predetermined extent, such that when in the detection zone, signals of varying amplitudes are produced. The marker must pass correctly oriented and in close proximity to the coils in the detection zone. It is primarily a device intended for access or inventory control and is expensive to produce.

Although U.S. Pat. No. 4,489,313-Pfister discloses a phase detector, it is not the phase of transmitted and returned signals that is determined, but two different parts of the returned signal.

The foregoing references indicate that markers utilizing a single strip of soft magnetic material can be deactivated by placing one or more elements of a high coercivity material along the length of the single strip. A magnetic bias applied to and retained by the high coercivity material reduces the harmonic generation of the single, soft magnetic strip. This technique is often unreliable, and usually is ineffective when the marker encounters the high field intensity of the transmitter and a closely coupled, highly sensitive receiver. Such a technique is also particularly ineffective for preventing false alarms due to the presence of multiple deactivated tags. The deactivation technique of such prior art systems is such that the harmonic signal generated by the soft magnetic material is normally not completely eliminated. Assuming, for example, that a system is effective to reduce the amplitude of the harmonic signal to ten percent (10%) of its normal level, then a consumer carrying ten deactivated tags on ten legitimately purchased articles will likely set off an alarm due to the cumulative amplitudes of the ten damped harmonic signals.

A deactivation system taught by U.S. Pat. No. 3,820,104-Fearon seeks to deactivate tags more effectively by utilizing a high coercivity element capable of imposing a plurality of pairs of alternate magnetic poles on the soft magnetic material. Even assuming that such a technique is more effective in preventing generation of harmonic signals by markers, such harmonic signals are nevertheless still generated at low amplitude levels. A sufficiently large number of deactivated markers can still be expected to generate a false alarm condition.

The invention disclosed in U.S. Pat. No. 4,622,542, the teachings of which are fully incorporated herein by reference, is based upon the discovery that when a suitable conductor, such as aluminum or copper, partially or totally encloses a core of soft magnetic material, the phase of the harmonics produced will be shifted (delayed in time). The amount of phase shift induced is controlled largely by the amount and resistivity of the conductor surrounding the magnetic material. It is feasible to shift any harmonic or groups of harmonics by any amount, through 360 degrees. However, some loss of harmonic amplitude is encountered as the conductor thickness increases and as the harmonic number increases.

The ability to control harmonic phase permits the generation of signals having a unique signature, apart from both ferrous alloys and soft magnetic materials. This avoids the accidental detections plaguing prior art systems as described above. In addition, a number of codes can be established according to the phase shift induced. The phase shift is not affected by a low level, external magnetic bias, in that odd order products are totally unaffected and even products shift by ±180 degrees.

In a very simple embodiment of a deactivatable tag according to this invention, which tag is suitable for use in a phase shift dependant magnetic article surveillance system, a tag or marker comprises a core of soft magnetic material surrounded by a ring of electrically conductive material. A second ferromagnetic element, having a higher coercivity than the core material, is placed over all or a portion of the encircling conductive material. In accordance with the teachings of U.S. Pat. No. 4,622,542, the conductive material is responsible for a predetermined phase shift of the harmonic signal generated by the marker in a surveillance or detection zone. However, it has been discovered that whenever the higher coercivity magnetic material is itself magnetized by an external magnetic field, it has the effect of shutting off that portion of the marker (i.e., the core) so that the harmonic signal is not affected by the conductive material. In effect, the core becomes blind to the presence of the conductive material and the harmonic signal is not phase shifted by the predetermined amount necessary to constitute an alarm condition. According, the problem of false alarms due to the presence of multiple deactivated tags is eliminated altogether, as the reduced phase shifts of deactivated tags are not cumulative. In other words, ten harmonic signals, each of which is shifted by only ten degrees, rather than for example by 100 degrees, will not appear to be cumulatively shifted by 100 degrees.

Development of deactivatable coded markers according to this invention brought to light a potential difficulty with multiply coded markers. The phase of odd order marker generated harmonics is dependant upon the saturation characteristics of the soft magnetic material, and the saturation characteristic changes somewhat as the field intensity of the transmitted signal varies. In other words, when a coded marker enters a detection zone, the intensity of the transmitted electromagnetic field tends to vary. The variation in intensity causes the phase of the odd harmonics to shift to some degree. This does not present a problem for basic kinds of markers coded only for on or off theft detection systems, but eventually causes a problem when high resolution is needed in order to decode relatively small phase shifts. It has been discovered that this problem can be solved by incorporating into an article surveillance system, operating on phase shifted harmonics, means for automatically adjusting the transmitted reference signals responsive to a characteristic of the received harmonic signals to compensate for the variation due to marker presence in the detection zone and thereby prevent the random variation in the phase shift of the harmonic signals. Presently, it is preferred that the automatic adjusting means alter the intensity of the transmitted reference signals responsive to the intensity of the received harmonic signals, and in particular, those received signals corresponding to the third harmonic. Such means, which can be embodied in an automatic gain control circuit, automatically adjust the intensity of the transmitted signal to maintain a constant harmonic intensity level in the receiver, which results in very stable harmonic phase angles. Such stable harmonic phase angles enable very high resolution and very large numbers of codes.

SUMMARY OF THE INVENTION

It is an object of this invention to provide an article surveillance system utilizing deactivatable encoded magnetic markers adapted to be carried by articles or persons to be monitored in a detection zone.

It is another object of this invention to provide a method for deactivating encoded magnetic markers carried by persons or articles in a detection zone.

It is still another object of this invention to provide a deactivatable encodable magnetic marker, capable of coding for large numbers of different codes and capable of selective deactivation, in whole or in part.

It is yet another object of this invention to provide more reliable detection of deactivatable encoded magnetic markers in article surveillance systems.

It is yet another object of this invention to provide article surveillance systems with improved deactivatable encodable magnetic markers for such systems, based upon detection of the phase shifted harmonics of a phase locked reference signal of a fundamental frequency, and the degree of the phase shift.

These and other objects are accomplished by a deactivatable coded marker for use in article surveillance systems wherein coded markers are carried by monitored articles, the marker comprising: a core of soft magnetic material; an electrically conductive material at least partly surrounding the core, by reason of which the marker will generate a phase shifted harmonic signal responsive to a reference signal; and, a magnetizable element of high coercivity adjacent to and overlying the electrically conductive material, the marker generating phase shifted harmonic signals when the high coercivity element is not magnetized but generating a non phase shifted harmonic signal responsive to the reference signal when the high coercivity element is magnetized, whereby the high coercivity element neutralizes the effect of the electrically conductive material when magnetized. Such a deactivatable marker may further comprise: a plurality of cores of soft magnetic material, characterized by the generation of a plurality of separately identifiable harmonic signals responsive to the reference signal; a plurality of electrically conductive elements at least partly surrounding each of the plurality of cores respectively, by reason of which the marker will generate a plurality of phase shifted, but separately identifiable harmonic signals responsive to the reference signal; and, a plurality of separately magnetizable elements of high coercivity adjacent to and overlying each of the electrically conductive elements respectively, whereby the high coercivity elements may be utilized to selectively neutralize the effect of any number of the plurality of the electrically conductive elements on each marker. In a deactivatable coded marker having first and second cores of soft magnetic material, first and second electrically conductive elements at least partly surrounding each of the first and second cores respectively and first and second separately magnetizable elements of high coercivity adjacent to and overlying each of the electrically conductive elements, the first and second cores may be characterized by the generation of mainly even order and mainly odd order of harmonics respectively, responsively to the reference signal. The first core of magnetic material may be characterized by a very low coercivity and moderate saturation level relative to the second core and the second core may be characterized by a much higher coercivity and a lower saturation level relative to the first core. Such deactivatable coded markers may also comprise at least one magnetizable element having separately magnetizable portions overlying one or more electrically conductive elements, whereby the separate portions may be utilized to selectively neutralize one or more of the electrically conductive elements.

These and other objects of the invention are also accomplished by an article surveillance system, comprising: means for generating and transmitting phase locked reference signals in a detection zone; a plurality of the deactivatable coded markers, each marker having: a core of soft magnetic material; an electrically conductive material at least partly surrounding the core, by reason of which the marker will generate harmonic signals of a predetermined phase shift responsive to the reference signals; and, a magnetizable element of high coercivity adjacent to and overlying electrically conductive material, the presence of a coded marker in the detection zone tending to cause a variation of the transmitted reference signals which tends to induce a certain random variation in the phase shift of the harmonic signals; means for receiving the phase shifted harmonic signals generated by active coded markers in the detection zone; means for automatically adjusting the transmitted reference signals responsive to a characteristic of the received harmonic signals to compensate for the variation due to marker presence in the detection and thereby prevent the random variation in the phase shift of the harmonic signals; means for determining the relative phase shift between the reference signals and the harmonic marker signals; and, means for generating a control signal responsive to identification of a valid code by the determining means. Such a surveillance system may further comprise means for selectively magnetizing and demagnetizing high coercivity material to activate and deactivate selective markers, each of the markers generating the phase shifted harmonic signal when the high coercivity element is not magnetized but generating a non phase shifted harmonic signal responsive to the reference signal when the high coercivity element is magnetized, whereby the high coercivity element neutralizes the effect of the electrically conductive material when magnetized. The automatic adjusting means preferably alters the intensity of the transmitted reference signals responsive to the intensity of the received harmonic signals, and in particular, to the intensity of those received signals corresponding to the third harmonic. Such an article surveillance system can be utilized with deactivatable coded markers as described above, including first, second or a plurality of soft magnetic material cores, respective electrically conductive elements and respective high coercivity elements.

These and other objects of the invention are further accomplished by a method for conducting surveillance of articles in a detection zone, comprising the steps of: providing each article with a deactivatable coded marker having means for generating harmonic signals of a predetermined phase shift responsive and relative to reference signals and having means for preventing generation of the harmonic signals; transmitting phase locked reference signals at a fundamental frequency into the detection zone; receiving phase shifted harmonic signals generated by each active marker in the detection zone responsive to the phase locked reference signal, the presence of a coded marker in the detection zone tending to cause variation in the transmitted reference signals which tends to induce a certain random variation in the phase shift of the harmonic signal; automatically adjusting the transmitted reference signals responsive to a characteristic of the received harmonic signals to compensate for the variation due to marker presence in the protection zone thereby preventing the random variation in the phase shift to the harmonic signals; and, measuring the phase shift between the reference signals and the harmonic marker signals, the degree of phase shift being related to positive identification of an active marker in the detection zone and being related positive identification of a particular code carried by a marker in the detection zone. The method may further comprise the step of continuously adjusting the intensity of transmitted signals responsive to the intensity of the received harmonic signals, and in particular, responsive to the intensity of those received signals corresponding to the third harmonic. The method may also comprise the steps of selectively activating and deactivating the coded markers, either wholly or in part.

BRIEF DESCRIPTION OF THE DRAWINGS

Presently preferred embodiments of the invention are shown in the following drawings, it being understood, however, that the invention is not limited to the precise arrangements and instrumentalities shown.

FIG. 1 is a block diagram of an article surveillance system according to this invention.

FIG. 2 is a perspective diagrammatic view of a deactivatable coded marker according to this invention.

FIG. 3 is a diagrammatic side view of the marker shown in FIG. 2, illustrating the deactivation technique.

FIG. 4 is a perspective diagrammatic view of an alternative embodiment of a marker, having separately coded, separately activatable portions.

FIG. 5 is a diagrammatic representation showing a harmonic shifted relative to its original state for an active marker and an unshifted harmonic for a deactivated marker.

DETAILED DESCRIPTION OF THE PREFERRED EMBODIMENTS

An article surveillance system 8 according to this invention is shown in block diagram form in FIG. 1. For purposes of simplicity, the system illustrated is a theft detection system rather than, for example, an inventory control system. The oscillator 10 generates signals which are phase locked to one another and which are exact multiples of the fundamental frequency being transmitted. The fundamental frequency is relatively free of harmonic distortion. The fundamental signal is applied to the transmitter/amplifier 14 where it is amplified. The amplified signal is coupled to the transmitter antenna 16 which is composed of one or more turns of copper wire and transmitted into detection zone 26. The resultant transmitted signal is preferably a substantially pure sine wave of electromagnetic energy and is within a preferred range of 100 Hz to 10,000 Hz.

One or more phase locked reference signals are coupled from the oscillator 10 to the phase comparator 22 by a connection 24. The receiver antenna 18 is composed of one or more turns of copper wire and is coupled to a receiver/amplifer 20.

The receiver/amplifier 20 amplifies and filters all signals received from the detection zone 26 until only preselected harmonics of the fundamental frequency are present. The harmonic(s) are coupled to the phase comparator 22 where a direct comparison is made to the reference signal(s). When the system is used for theft detection, a correct phase correlation between received and reference signals will cause the phase comparator 22 to produce an output to the alarm indicator 28. The alarm may be an audible or visual signal or a combination of both.

Whenever a coded marker enters detection zone 26 the intensity of the transmitted electromagnetic field tends to vary, sometimes greatly. The variation in field intensity causes the phase shift of odd harmonics generated by the marker to shift randomly, at least to some degree. Such a shift is not a problem in a simple theft detection system, but can present problems where high resolution of a phase shift is necessary to properly distinguish between large numbers of codes. In order to prevent such shifting, an automatic gain control circuit 12 is interposed between the output of oscillator 10 and the input of transmitter/amplifier 14. The automatic gain control circuit 12 continuously adjusts the intensity of the transmitted reference signal responsive to a characteristic of the received harmonic signal, through feedback connection 30, which emanates from the output of the receiver/amplifier 20. Adjustment of the intensity of the transmitted reference signal compensates for the variation due to marker presence in the detection zone 26 and thereby prevents the random variation in the phase shift of the harmonic signals. In the presently preferred embodiment, the automatic gain control circuit 12 alters the intensity of the transmitted reference signals responsive to the intensity of those received signals corresponding to the third harmonic.

When the system is used for monitoring access or inventory, markers effecting different degrees of phase shift will pass through the detection zone of the system. The signal generated by each marker will have a different phase orientation to the reference signal. This difference will be detected by the phase comparator, and depending upon the application information, may be transferred to a cash register, computer, electromechanical actuator or any combination of these.

With reference to FIG. 2, a deactivatable marker according to this invention is generally designated 40. The marker 40 has a core 42 of soft magnetic material, for example Permalloy or any of the metallic glass materials. The core is least partly surrounded by an electrically conductive material 44, for example copper or aluminum. Merely by way of example, and without limitation, a typical ribbon-form core may be 7.5 cm long, 0.25 cm wide and 0.0025 cm thick. The conductor 44 may be wrapped around the magnetic material or may be plated, evaporated or sputtered directly on the magnetic core 42. The magnetic material may be in the form of a plate, strip (ribbon), rod or wire. The application of conductive material may be continuous or may be distributed in discrete sections. More specific examples of phase shift markers are disclosed in U.S. Pat. No. 4,622,542.

An element 46 comprising high coercivity material is disposed adjacent and overlying (deemed equivalent to underlying, coextensive with, etc.) the conductor 44. Such high coercivity materials are well known to those skilled in the art, one such material being sold under the tradename Vicalloy. Various examples of materials exhibiting high or low coercivity, different saturation characteristics and the like are disclosed in the references cited in the prior art section, and such descriptions are incorporated herein by reference.

With further reference to FIG. 3, whenever the element 46 of high coercivity is unmagnetized, the conductor 44 will cause the soft magnetic material strip 42 to generate phase shifted harmonic signals responsive to a transmitted signal of fundamental frequency, in accordance with the teachings of U.S. Pat. No. 4,622,542. Whenever element 46 is magnetized by an external field, magnetic flux indicated diagrammatically by lines of force 48 surround conductor 44, the length Y of which is preferably less than the length Y of the magnetic field imposed by element 46. The interesting effect of the magnetic field or bias imposed by element 46 is to render the soft magnetic material 42 blind to the presence of the electric conductor 44, so that all harmonics generated in the detection zone will not be phase shifted. If element 46 is smaller than conductor 44, then only a corresponding portion of core 42 will be deactivated, resulting in generation of phase shifted and non phase shifted harmonics.

With further reference to FIG. 5, the signal shown on base line A represents the normal or non phase shifted signal generated in the detection zone by a soft magnetic material (without conductor 44), for example strip 42. The presence of the conductor 44 causes the signal to be phase shifted as shown by the signal on base line B. Although the marker generated signal is phase shifted by distance d, its amplitude m2 is substantially the same as the unshifted harmonic signal, which is amplitude m1. The signal on base line B also represents the harmonic response of marker 40 when element 46 is not magnetized, that is, when the marker is active. When element 46 is magnetized, and masks or neutralizes the effect of the conductor 44, the signal generated by the marker is as shown on base line C. The signal is attenuated in amplitude, having an amplitude of m3, which is considerably less that amplitudes m1 and m2. However, the phase of the signal has shifted back to the original phase by distance d. Accordingly, even if dozens or hundreds of the activated markers 40 are passed through detection zone 26, there will be no false alarm, because any nominal or random phase shift will not be cumulative or additive. Deactivation of markers according to this invention is very, very reliable.

A deactivatable, multiple code marker is diagrammatically illustrated in FIG. 4 and generally designated 60. The marker 60 comprises first and second cores of soft magnetic material 62 and 64, first and second electrically conductive elements 66 and 68, at least partly surrounding each of the first and second cores respectively and first and second separately magnetizable elements 70 and 72, of high coercivity adjacent to and underlying each of the electrically conductive elements respectively. In a presently preferred embodiment, the first and second cores of soft magnetic material 62 and 64 are characterized by the generation of mainly even order and mainly odd order harmonics respectively, responsive to the reference signal. The first core of soft magnetic material 62 is characterized by a very low coercive force and moderate saturation level. In a theft detection system, a suitable material might be Permalloy. Where the marker is used as the functional part of a security access system in an office or factory or the like, or when the marker is used for industrial sorting applications, a suitable material might be metallic glass. In any event, an element having a very low coercivity and a moderate saturation level will initially produce even order harmonics in the presence of a low intensity electromagnetic field, and in particular, will tend to generate second order harmonics. The second core of soft magnetic material 64 has a much higher coercive force than the first element, but a lower saturation level. Such an element will initially produce odd order harmonics, particularly third order harmonics, at the same time that the first core of soft magnetic material produces even harmonics. The phase shifts of the even and odd (second and third) harmonics can be separately adjusted by the separate electrical conductors 66 and 68. Use of a single electrical conductor surrounding both cores 62 and 64 would provide for a similar phase shift of both even and odd harmonics. Alternatively, such a marker can be selectively activated and deactivated, in whole or in part, by providing separately magnetizable elements of 70 and 72 of high coercivity. As a further alternative, as demonstrated by the dotted lines, a single magnetizable element 74 of high coercivity material, having separately magnetizable portions **70*a* and 72*a* can be provided instead. As yet another alternative, a single magnetizable element of high coercivity can overlie both conductors 66 and 68**, for always activating and deactivating both simultaneously.

In the simplest sense, members or elements 62, 66 and 70 can be thought of as a subsystem for encoding a first binary bit and members or elements 64, 68 and 72 can be thought of as another subsystem for encoding a second binary bit, the separate activation and deactivation of each providing a marker capable of exhibiting four codes (0,0; 0,1; 1,0; 1,1). However, the fine resolution which can be achieved in measuring marker harmonic phase shifted signals enables each of the marker coding systems or subsystems to generate tens, hundreds, thousands or even tens of thousands of codes. Even if each coding subsystem is capable of generating only 100 identifiable codes, the two subsystems together, where each is active, can generate ten thousand codes. This number can be further multiplied by the independent activation, which as described above, can operate with even and odd harmonics respectively and deactivation of the two coding subsystems. The coding potential for such a system, which includes reliable activation and deactivation, far surpasses any such systems contemplated in the prior art.

The particulars of the phase locked oscillator, transmitter, receiver, automatic gain control, antennas, phase comparator and downstream control equipment (alarms, cash registers computers, etc.) are well known in the art. The dimensions of and choices among appropriate materials for the markers are capable of virtually infinite variation within the general scope of the invention, namely the generation and detection of phase shifted harmonics. The number of codes possible is theoretically infinite, but is of course limited by practical engineering constraints and system and component tolerances and costs. The system taught herein, which stabilizes field intensity in the detection zone, enables very great resolution of marker generated harmonic phase shifts. Such resolutions enables very large numbers of codes.

This invention may be embodied in other specific forms without departing from the spirit or essential attributes thereof. Accordingly, reference should be mde to the appended claims, rather than the foregoing specification, as indicating the scope of the invention.

What is claimed is:

1. A deactivatable coded marker for use in article surveillance systems wherein coded markers are carried by monitored articles, the marker comprising:

at least one core of soft magnetic material;

at least one electrically conductive element at least partly surrounding the core, by reason of which the marker will generate a phase-shifted harmonic signal responsive to a reference signal; and, at least magnetizable element of high coercivity adjacent to and overlying the electrically conductive element, the marker generating the phase-shifted harmonic signal when the high coercivity element is not magnetized but generating a non-phase-shifted harmonic signal responsive to the reference signal when the high coercivity element is magnetized, whereby the high coercivity element neutralizes the effect of the electrically conductive element when magnetized.

2. The deactivatable coded marker of claim 1, comprising:

first and second cores of soft magnetic material, characterized by the generation of mainly even order and mainly odd order harmonics respectively responsive to the reference signal;

first and second electrically conductive elements at least partly surrounding each of the first and second cores respectively, by reason of which the marker will generate phase-shifted even and odd order harmonic signals responsive to the reference signal; and, first and second separately magnetizable elements of high coercivity adjacent to and overlying each of the electrically conductive elements respectively, whereby the high coercivity elements may be utilized to selectively neutralize the effect of either or both of the first and second electrically conductive elements.

3. The deactivatable coded marker of claim 2, wherein the first core of magnetic material is characterized by a low coercivity and moderate saturation level relative to the second core and the second core is characterized by a higher coercivity and a lower saturation level relative to the first core.

4. The deactivatable coded marker of claim 1, comprising:

first and second cores of soft magnetic material, characterized by the generation of mainly even order and mainly odd order harmonics respectively responsive to the reference signal;

first and second electrically conductive elements at least partly surrounding each of the first and second cores respectively, by reason of which the marker will generate phase-shifted even and odd order harmonic signals responsive to the reference signal; and, at least one magnetizable element of high coercivity adjacent to and overlying both of the electrically conductive elements, whereby the high coercivity element may be utilized to neutralize the effect of the first and second electrically conductive elements.

5. The deactivatable marker of claim 4, wherein the at least one magnetizable element comprises separately magnetizable portions overlying the first and second electrically conductive elements respectively, whereby the separate portions may be utilized to selectively neutralize the effect or either or both of the first and second electrically conductive elements.

6. The deactivatable marker of claim 1, comprising:

a plurality of cores of soft magnetic material, characterized by the generation of a plurality of separately identifiable harmonic signals responsive to the reference signal;

a plurality of electrically conductive elements at least partly surrounding each of the plurality of cores respectively, by reason of which the marker will generate a plurality of phase-shifted, but separately identifiable harmonic signals responsive to the reference signal; and a plurality of separately magnetizable elements of high coercivity adjacent to and overlying each of the electrically conductive elements respectively, whereby the high coercivity elements may be utilized to selectively neutralize the effect of any number of the plurality of electrically conductive elements.

7. An article surveillance system, comprising:

means for generating and transmitting phase locked reference signals in a detection zone;

a plurality of deactivatable coded markers, each marker having:

at least core of soft magnetic material;

at least one electrically conductive element at least partly surrounding the core, by reason of which the marker will generate harmonic signals of predetermined phase shift responsive to the reference signals; and, a magnetizable element of high coercivity adjacent to and overlying the electrically conductive element, the presence of a coded marker in the detection zone tending to cause a variation in the transmitted reference signals which tends to induce a certain random variation in the phase shift of the harmonic signals;

means for receiving the phase-shifted harmonic signals generated by active coded markers in the detection zone;

means for automatically adjusting the transmitted reference signals responsive to a characteristic of the received harmonic signals to compensate for the variation due to marker presence in the detection zone and thereby prevent the random variation in the phase shift of the harmonic signals;

means for determining the relative phase shift between the reference signals and the harmonic marker signals; and, means for generating a control signal responsive to identification of a valid code by the determining means.

8. The surveillance system of claim 7, further comprising means for selectively magnetizing and demagnetizing said high coercivity elements to activate and deactivate selected markers, each of the markers generating the phase-shifted harmonic signal when the high coercivity element is not magnetized but generating a non-phase-shifted harmonic signal responsive to the reference signal when the high coercivity element is magnetized, whereby the high coercivity element neutralizes the effect of the electrically conductive material when magnetized.

9. The surveillance system of claim 7, wherein the automatic adjusting means alters the intensity of the transmitted reference signals responsive to the intensity of the received harmonic signals.

10. The surveillance system of claim 9, wherein the automatic adjusting means alters the intensity of the transmitted reference signals responsive to the intensity of those received signals corresponding to the third harmonic.

11. The surveillance system of claim 8, wherein the automatic adjusting means alters the intensity of the transmitted reference signals responsive to the intensity of the received harmonic signals.

12. The surveillance system of claim 11, wherein the automatic adjusting means alters the intensity of the transmitted reference sighals responsive to the intensity of those received signals corresponding to the third harmonic.

13. The surveillance system of claim 8, wherein each of the markers comprises:

first and second cores of soft magnetic material, characterized by the generation of mainly even order and mainly odd order harmonics respectively responsive to the reference signal;

first and second electrically conductive elements at least partly surrounding each of the first and second cores respectively, by reason of which the marker will generate phase-shifted even and odd order harmonic signals responsive to the reference signal; and, first and second separately magnetizable elements of high coercivity adjacent to and overlying each of the electrically conductive elements respectively, whereby the high coercivity elements may be selectively activated and deactivated to neutralize the effect of either or both of the first and second electrically conductive elements.

14. The surveillance system of claim 8, wherein each of the markers comprises:

a plurality of cores of soft magnetic material, characterized by the generation of a plurality of separately identifiable harmonic signals responsive to the reference signal;

a plurality of electrically conductive elements at least partly surrounding each of the plurality of cores respectively, by reason of which the marker will generate a plurality of phase-shifted, but separately identifiable harmonic signals responsive to the reference signal; and, a plurality of separately magnetizable elements of high coercivity adjacent to and overlying each of the electrically conductive elements respectively, whereby the high coercivity elements may be selectively activated and deactivated to neutralize the effect of any number of the plurality of electrically conductive elements.

15. A method for conducting surveillance of articles in a detection zone, comprising the steps of:

providing each article with a deactivatable coded marker having means for generating harmonic signals of a predetermined phase shift responsive and relative to reference signals and having means for preventing generation of the harmonic signals;

transmitting phase locked reference signals at a fundamental frequency into the detection zone;

receiving phase shifted harmonic signals generated by each marker in the detection zone responsive to the phase locked reference signal, the presence of a coded marker in the detection zone tending to cause a variation in the transmitted reference signals which tends to induce a certain random variation in the phase shift of the harmonic signals;

continuously adjusting the transmitted reference signals responsive to a characteristic of the received harmonic signals to compensate for the variation due to marker presence in the detection zone and thereby prevent the random variation in the phase shift of the harmonic signals; and, measuring the phase shift between the reference signals and the harmonic marker signals, the degree of phase shift being related to positive identification of an active marker in the detection zone.

16. The method of claim 15, the steps of continously adjusting comprising continuously adjusting the intensity of the transmitted reference signals responsive to the intensity of the received harmonic signals.

17. The method of claim 16, the steps of continuously adjusting comprising continuously adjusting the intensity of the transmitted reference signals responsive to the intensity of those received signals corresponding to the third harmonic.

18. The method of claim 15, further comprising the steps of selectively activating and deactivating the coded markers.

19. The method of claim 15, further comprising the steps of: providing each coded marker with:

at least first and second cores of soft magnetic material, characterized by the generating of at least two separately identifiable harmonic signals respectively responsive to the reference signal;

at least first and second electrically conductive elements at least partly surrounding each of the at least first and second cores respectively, by reason of which the marker will generate phase-shifted, but separately identifiable harmonic signals responsive to the reference signal; and, at least first and second separately magnetizable elements of high coercivity adjacent to and overlying each of the electrically conductive elements respectively, whereby the high coercivity elements may be utilized to selectively neutralize the effect of one or more of the at least first and second electrically conductive elements; and, activating and deactivating selected coded markers and selected parts of coded markers.

20. The method of claim 15, further comprising the step of generating a control signal responsive to the measurement of the phase shift.

* * * * *